United States Patent [19]

Sexton

[11] Patent Number: 4,972,204

[45] Date of Patent: Nov. 20, 1990

[54] LAMINATE, ELECTROFORMED INK JET ORIFICE PLATE CONSTRUCTION

[75] Inventor: Richard W. Sexton, Dayton, Ohio

[73] Assignee: Eastman Kodak Company, Rochester, N.Y.

[21] Appl. No.: 396,179

[22] Filed: Aug. 21, 1989

[51] Int. Cl.[5] ..... G01D 15/18; C25D 1/02

[52] U.S. Cl. ..... 346/75; 346/140 R; 204/9; 204/11; 204/14.1; 204/15

[58] Field of Search ..... 346/75, 140 R; 204/9, 204/11, 14.1, 15

[56] References Cited

U.S. PATENT DOCUMENTS

| | | | |
|---|---|---|---|
| 4,184,925 | 1/1980 | Kenworthy | 204/11 |
| 4,528,070 | 7/1985 | Gamblin | 204/11 |
| 4,675,083 | 6/1987 | Bearss et al. | 204/11 |
| 4,801,947 | 1/1989 | Lichtenberger et al. | 346/75 |

*Primary Examiner*—George H. Miller, Jr.
*Assistant Examiner*—Gerald E. Preston
*Attorney, Agent, or Firm*—John D. Husser

[57] ABSTRACT

An improved orifice plate for use in ink jet printing, includes a first elongated lamina composed of electroformed metal or metal-alloy having tensile or compressive stress condition and a second elongated lamina composed of a metal or metal-alloy electroformed onto said first lamina and having a counterbalancing stress condition.

11 Claims, 2 Drawing Sheets

LAMINATE, ELECTROFORMED INK JET ORIFICE PLATE CONSTRUCTION

FIELD OF INVENTION

The present invention relates to orifice plates for use in ink jet printing and, more specifically, to improved structural configurations and fabrication methods for such orifice plates.

BACKGROUND ART

The construction of orifice plates is a critical aspect of ink jet printers, and various materials and fabrication techniques have been utilized toward attaining desired dimensional preciseness and physical durability (e.g. against chemical attack or abrasion) for those critical elements. One highly useful approach described in U.S. Pat. No. 4,184,925 is to electroplate a metal, e.g. nickel, over a photoresist peg pattern on a mandrel for a period of time such that the openings over the photoresist pegs have been closed by the nickel to the exact diameter desired for the orifices. The orifice plate is subsequently thickened by forming another photoresist peg over the newly defined orifice (on the opposite side from the first peg) and electroplating with nickel to a final overall thickness of about 7.5 mils. Orifice plates fabricated according to the '925 patent teaching have been used in both continuous and drop-on-demand ink jet printing with good results.

In continuous ink jet printers the orifice plates receive acoustic stimulation to regulate drop break-up of continuous ink streams issuing from the orifices. This stimulation can be of the traveling wave or plane wave kinds (see, for example, U S. Pat. Nos. 3,822,508 and 4,646,104). The plane wave stimulation offers the advantage of more synchronous break-up of the jets of a linear array because the orifice plate is vibrated in a nominally planar state, e.g. in the directions of the jet streams. This reduces the necessary drop charging window in comparison to what is needed for the non synchronous drop break-up that is characteristic of traveling wave stimulation.

However, I have found that problems can occur when orifice plates, such as described in the '925 patent, are used in long array (e.g. about 4 inch) orifice plates stimulated via the planar wave approach. Specifically, for good acoustic transmission, orifice plates that are thicker and acoustically stiffer than those of the '925 patent are needed. The problem is compounded because the longer arrays must continue to be highly flat, and increasing the thickness of electroforms, such as in the '925 patent, tends to produce bowing because of incorporated tensile stresses.

SUMMARY OF INVENTION

A significant purpose of the present invention is to provide new and improved orifice plate constructions which avoid the above noted difficulties and operate effectively in longer array formats with planar wave stimulation. Another object of the present invention is to provide orifice plate constructions of increased thickness, while maintaining a high flatness for the array surface. A further object is to provide orifice plate constructions of enhanced acoustic stiffness. A related object of the present invention is to provide improved methods for fabricating orifice plate constructions such as mentioned above.

Thus, in one aspect the present invention constitutes a method of fabricating an ink jet orifice plate comprising the steps of (a) forming a plurality of substantially cylindrical resist pegs uniformly spaced in an array on a substrate; (b) plating the substrate with a metal or metal-alloy that exhibits a tensile or compressive stress to form a first lamina around the sides of the pegs and define a plurality of orifices; (c) forming a resist pattern extending over the plurality of orifices; and (d) plating onto said first lamina around the resist pattern with a metal or metal-alloy exhibiting an opposite, generally balancing, stress to that of said first lamina.

BRIEF DESCRIPTION OF DRAWINGS

The subsequent description of preferred embodiments refers to the accompanying drawings wherein.

DETAILED DESCRIPTION OF PREFERRED EMBODIMENTS

Figure 1:
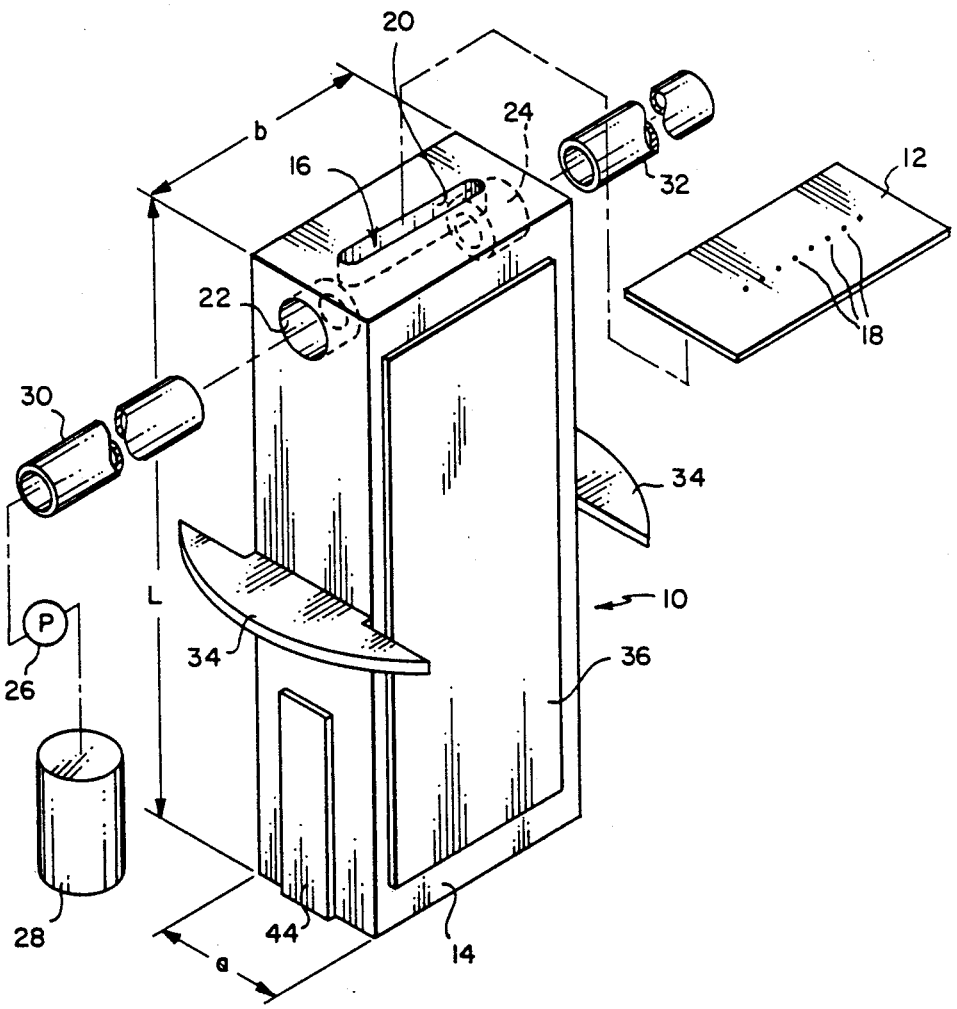
FIG. 1 PRIOR ART
FIG. 1 is a schematic perspective view showing one drop ejection component of a continuous ink jet print head of the kind in which the present invention is useful.

FIG. 1 shows schematically the drop ejection portion 10 of a plane-wave-stimulation, continuous ink jet print head assembly of the general kind in which orifice plates of the present invention are particularly useful. More specifically, the drop ejection portion 10 comprises a resonator body 14, which has ink inlet 22 and outlet 24 openings and an ink manifold region 20 formed in one end 16 thereof. As indicated by the broken lines, an orifice plate 12 having an array of orifices 18 is mounted over the outlet of manifold 22. Thus, when ink is supplied from a reservoir 28 under pressure by pump 26 through printer supply conduit 30 to the inlet 22, droplet streams are ejected through the orifices 18 of plate 12. Return conduit 32 can direct excess ink flow back to reservoir 28 in a known manner. The body portion 14 is mounted in the printer by brackets 34, located at nodal plane of its longitudinal mode of vibration. Piezoelectric strips 36 are located on opposing faces of the resonator body 14 and expand and contract in the length direction L of the resonator body. Therefore, the orifice plate is vibrated up and down through series of planes normal to the length direction, which planes are also normal to the direction of ink filaments ejected from orifices 18. Feed back tab 44 is provided for use in synchronizing vibrations with the printers drop charging and print media feed. A more complete description of print head structures such as shown in FIG. 1, is provided in U.S. Pat. No. 4,646,104, which also explains their advantages in providing plane wave stimulation.

The fabrication method and resulting orifice plate constructions of the present invention are particularly useful in allowing longer orifice plate arrays to be utilized in plane wave vibrational modes such as described above. FIGS. 2A to 2H illustrate one preferred fabrication method for producing orifice plates according to the present invention.

Figure 2A:
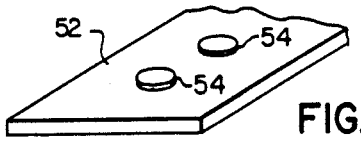
FIGS. 2A through 2H are perspective views illustrating successive stages of the fabrication of a laminate orifice plate construction in accord with one preferred embodiment of the present invention.
Figure 2B:
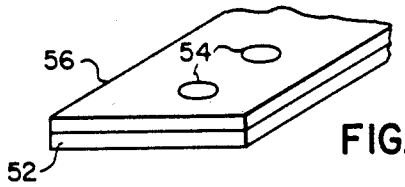

The first stages of the orifice plate fabrication method shown in FIGS. 2A and 2B can be similar to those described in U.S. Pat. No. 4,184,925. Thus, the orifice plate is formed by first preparing a suitable substrate 52, such as a plate of stainless steel. The stainless steel plate may be as thick as necessary to be sure it will remain flat and true. The substrate is then coated in known fashion with a photoresist material which is exposed through suitable masks and developed to form a series of cylindrical resist pegs 54. The resist pegs 54 remain on the substrate 52, as shown in FIG. 2A, after the unexposed resist is washed away.

Next, in accord with the present invention, as illustrated in FIG. 2B, the substrate 52 is plated with a metal alloy layer 56, e.g., a nickel alloy containing phosphorous or sulfur. The plating may be done, for example, by electroplating the substrate 52 in an appropriate electrolyte solution. During such electroplating process, the nickel alloy 56 is formed on the areas of the substrate which are conductive. As the layer 56 reaches and plates above the tops of resist pegs 54, the layer begins to creep inwardly around the top edges of the pegs 54. This occurs because the nickel alloy around the edges of the pegs is conductive and induces plating in a radial direction across the tops of the pegs, as well as in the outward direction away from the substrate. Plating of layer 56 is continued until the openings over the pegs have been closed by the nickel alloy to the diameters desired for defining orifices of the orifice plate.

Next, in accord with the present invention, the first lamina, layer 56, is added to by plating of a second lamina. Specifically, as shown in FIG. 2C, a photoresist channel element 57 is formed over the apertures of the first lamina 56 in a manner similar to the formation of resist pegs 56 Next, the second lamina, nickel layer 58, is plated upon the first lamina up to the top of channel element 57, see FIG. 2D. In accord with one preferred embodiment of the present invention non-alloyed nickel is used as the material of the second layer and can be electroplated in the same manner as the first lamina, but from a different electrolyte solution. In accord with the present invention, the fabrication of alternate laminae of alloy nickel and non alloy nickel enables a thicker orifice plate to be constructed, while maintaining the essential flatness of the orifice plate. Specifically, the electroplated alloyed nickel exhibits the characteristic of having a residual compressive stress and the electroplated, non-alloyed nickel exhibits the opposite characteristic, a residual tensile stress. These stresses tend to neutralize one another and thus avoid the orifice plate bow that has heretofore prevented the successful fabrication of "thicker" orifice plates.

In preferred fabrications of the present invention, the electroplating of alloyed and non-alloyed layers is repeated to form third and fourth laminae. Thus, FIG. 2E shows that another channel element 61 is formed of photoresist over channel element 57 and FIG. 2F shows that a third lamina 62 of alloyed nickel (e.g. containing sulfur or phosphorous nickel alloy) is then electroplated upon second lamina 58. It will be noted that the width of photoresist channel element 61 is slightly greater than that of channel element 57. This enhances adherence of resist element 61, as its bond with nickel layer 58 is superior to that with developed photoresist element 57.

Figure 2G:
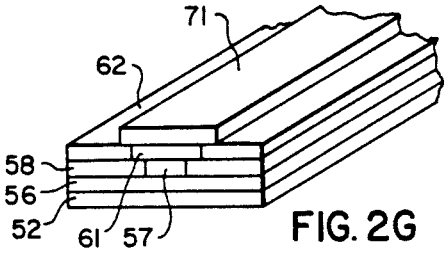
Figure 2C:
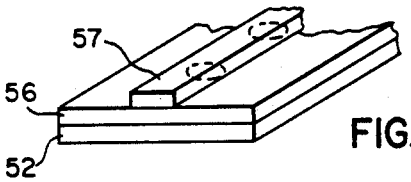
Figure 2H:
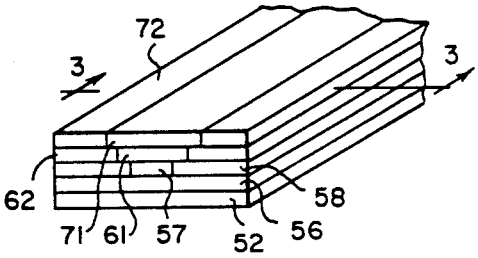
Figure 2D:
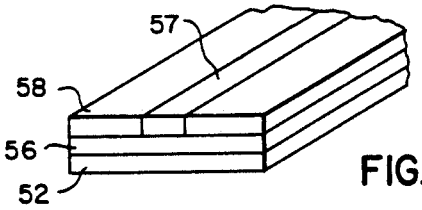
Figure 2E:
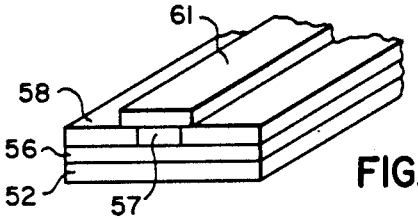
Figure 2F:
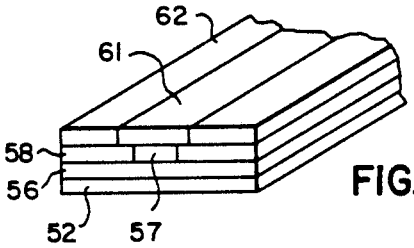

Next, as shown in FIG. 2G, a third channel element 71 is formed over element 61, again having a slightly greater width for adherence purposes. Then, a non-alloyed nickel layer 72 is electroplated up to the top of photoresist element 71, as shown in FIG. 2H.

Figure 3:
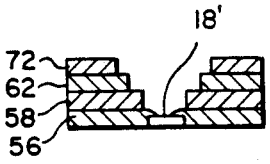
FIG. 3 is a cross section taken along the line 3—3 in FIG. 2H and illustrating one preferred laminate orifice plate construction in accord with the present invention.

Finally, the photoresist portions 54, 57, 61 and 71 are all removed and the completed laminate orifice plate construction, such as shown in FIG. 3, is ready for mounting with its channel side facing the manifold of the printer so that ink can be ejected through orifices 18'.

Materials for fabrication of laminated orifice plates can be selected from the group of metals that are typically commercially electroformed to a thickness of 3 mils or more. These alloys include copper base alloys such as copper, brass, or bronze. Nickel and cobalt and their alloys are also useful in this application. Nickel and cobalt deposits containing sulfur, phosphorous, or boron, or cobalt-nickel alloy, or nickel-base alloys with copper, iron, chromium, molybdenum, tungsten, tin, palladium or vanadium and combinations of alloying agents are useful for forming laminated structures. Physical properties and chemical compositions for electroforming metals and alloys useful for this invention are available in the literature; a handbook, "The Properties of Electrodeposited Metals and Alloys" by W. H. Safranek is particularly helpful for selection of suitable layers.

For ink Jet printing, inks are generally slightly alkaline so that copper and copper-based alloys are subject to corrosion in this oxidative medium. Therefore, nickel and cobalt and their alloys which form protective oxides in alkaline media are preferred for this application. It is also important to avoid layer combinations that exhibit high galvanic potentials such as nickel and copper alloys placed together. One preferred choice therefore is a combination of two materials having similar corrosion potentials such as pure nickel and nickel alloys.

Because it is not practical to control stress to exactly zero in multilayer constructions, it is very desirable, in accord with this invention, to choose successive alloy layers such that odd-numbered layers exhibit compressive stress and even-numbered layers, tensile stress, or vice-versa. In this manner, a balanced structure is produced that will not warp when released from the substrate.

For formation of multilayer plates having minimal bow, it is also desirable to choose metals and alloys with similar thermal coefficients of expansion because electroforming is usually performed in solutions heated above ambient. Sandwiched layers having wide variance in thermal expansion such as stainless steel (9.6 $\mu$ inch/inch/°F.) and nickel (7.4 $\mu$ inch/inch/°F.) can build sufficient stress to cause bowing when electroformed at temperatures above ambient.

Based on the foregoing, there are many combinations of metals and alloys which will occur to those skilled in the art for practice of the present invention. The following are offered as functional examples.

Example

A four-layered laminated structure that exhibited good corrosion resistance and structural rigidity was formed using two separate plating baths for alternating tensile and compressive layers of nickel alloys and nickel.

A first layer about 2 mils thick was formed in a nickel phosphorous alloy Bath I composed as follows:

| | | |
|---|---|---|
| Bath I | Nickel Sulfate, Hexahydrate | 150 g/l |
| | Boric Acid | 30 g/l |

-continued

| | | |
|---|---|---|
| Phosphorous Acid | 15 | g/l |
| Formic Acid | 10 | cc/l |
| pH | 2.0 | |
| Temperature | 60° C. | |
| Current Density | 10 | Amps/dm$^2$ |

This deposit had tensile stress of about +10,000 psi.

After suitable application of photoresist and reactivation of the first layer, a second layer was applied from Bath II, a sulfur-containing solution that produced a compressively stressed deposit:

| | | | |
|---|---|---|---|
| Bath II | Nickel Sulfate, Hexahydrate | 350 | g/l |
| | Nickel Chloride, Hexahydrate | 90 | g/l |
| | Boric Acid | 40 | g/l |
| | Saccharin | .15 | g/l |
| | pH | 4.5 | |
| | Temperature | 50° C. | |
| | Current Density | 4 | Amp/dm$^2$ |

This deposit, plated about 3 mils thick, had compressive stress of about −10,000 psi.

Subsequently, the second deposit was patterned photolithographically and activated for plating a third layer again from Bath I to 3 mils thickness.

Finally, a 2 mil layer was plated from Bath II to provide a mechanically balanced and corrosion resistant four layer orifice plate structure Thus, by carefully choosing corrosion resistant metals and alloys having opposite stress conditions, flat, multilayer plates having good acoustic properties have been fabricated. Other examples of preferred systems include tin-nickel/pure nickel, nickel-phosphorous boron/nickel-sulfur, and pure nickel/nickel-sulfur. The various electrolyte compositions that produce such desired stress levels are described in the technical literature, such as the handbook by Safranek cited above.

The invention has been described in detail with particular reference to certain preferred embodiments thereof, but it will be understood that variations and modifications can be effected within the spirit and scope of the invention.

I claim:

1. An improved orifice plate for use in ink jet printing, said orifice plate comprising:

(a) a first elongated lamina, of uniform thickness, composed of an electroformed metal or metal-alloy having a plurality of predeterminedly sized orifice openings through its thickness dimension at spaced locations along its length dimension, said first lamina having a tensile or compressive condition; and (b) a second elongated lamina, of uniform thickness, composed of a metal or metal-alloy electroformed onto said first lamina and having conduit means aligned with said orifice openings of said first lamina, said second lamina having an opposite stress condition to said first lamina.

2. The invention defined in claim 1 wherein one of said lamina has an internal compressive stress and the other of said lamina has a substantially counterbalancing internal tensile stress.

3. The invention defined in claim 1 wherein said orifice plate has an overall thickness greater than about 10 mils.

4. The invention defined in claim 3 wherein said orifice plate has a length greater than about 4 inches.

5. The invention defined in claim 1 wherein one of said lamina is composed of electroplated nickel and that of said lamina is composed of an electroplated alloy of nickel containing sulfur or phosphorous.

6. The invention defined in claim 1 wherein said orifice plate further comprises third and fourth laminae electroformed successively over said second lamina and each having opposing stress conditions.

7. The invention defined in claim 1 wherein said first and second laminae have approximately equal thermal coefficients of expansion.

8. The invention defined in claim 1 wherein said first and second laminae as a pair exhibit low galvanic potential.

9. An improved orifice plate for use in ink jet printing, said orifice plate comprising:

(a) a first elongated lamina, of uniform thickness, composed of electroformed metal or metal-alloy exhibiting a compressive stress condition; and (b) a second elongated lamina, of uniform thickness, composed of a metal or metal-alloy electroformed onto said first lamina and having a tensile stress condition balancing said first lamina stress.

10. A method of fabricating an ink jet orifice plate comprising the steps of:

(a) forming a plurality of substantially cylindrical resist pegs uniformly spaced in an array on a substrate;

(b) plating the substrate with a metal or metal-alloy to form a first lamina having a tensile or compressive stress condition around the sides of said pegs;

(c) forming a resist pattern extending over said plurality of orifices; and (d) plating onto said first lamina over said resist pattern with a metal or metal-alloy to form a second lamina with a stress condition opposite that of said first lamina.

11. A method of fabricating an ink jet orifice plate comprising the steps of:

(a) forming a plurality of substantially cylindrical resist pegs uniformly spaced in an array on a substrate;

(b) plating the substrate to form a first lamina of a metal or metal-alloy to define a plurality of orifices;

(c) forming a resist pattern extending over said plurality of orifices; and (d) plating onto said first lamina around with the other of said metal or metal-alloy.

* * * * *